US008746998B2

(12) United States Patent
Morozumi

(10) Patent No.: US 8,746,998 B2
(45) Date of Patent: Jun. 10, 2014

(54) DOT IMPACT PRINTER

(75) Inventor: Choji Morozumi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 308 days.

(21) Appl. No.: 13/221,266

(22) Filed: Aug. 30, 2011

(65) Prior Publication Data

US 2012/0051821 A1 Mar. 1, 2012

(30) Foreign Application Priority Data

Aug. 31, 2010 (JP) ..... 2010-193944

(51) Int. Cl.
*B41J 2/23* (2006.01)
*B41J 2/24* (2006.01)

(52) U.S. Cl.
USPC ..... 400/124.24

(58) Field of Classification Search
USPC ..... 400/124.24, 408, 412
See application file for complete search history.

(56) References Cited

FOREIGN PATENT DOCUMENTS

| | | | | | |
|---|---|---|---|---|---|
| JP | 58031789 | A | * | 2/1983 | ..... B41J 35/04 |
| JP | 62189179 | A | * | 8/1987 | ..... B41J 11/62 |
| JP | 06183036 | A | * | 7/1994 | ..... B41J 2/24 |
| JP | 06-344611 | A | | 12/1994 | |
| JP | 09329886 | A | * | 12/1997 | ..... B41J 2/24 |
| JP | 10044536 | A | * | 2/1998 | ..... B41J 2/24 |
| JP | 10-202981 | A | | 8/1998 | |
| JP | 10202981 | A | * | 8/1998 | ..... B41J 25/34 |

* cited by examiner

*Primary Examiner* — Nguyen Ha
(74) *Attorney, Agent, or Firm* — Lowe Hauptman & Ham, LLP

(57) ABSTRACT

A dot impact printer including a printhead unit having a wire dot head that strikes an ink ribbon against a recording medium to print, and a head support frame that supports the wire dot head; a path forming member that forms the recording medium conveyance path at the printing position of the wire dot head; and a first contact group having at least three contact points disposed to the head support frame that contact the path forming member proximally to the wire dot head for positioning to the path forming member in the head pin projection direction.

5 Claims, 5 Drawing Sheets

DOT IMPACT PRINTER

The entire disclosure of Japanese Patent Application No: 2010-193944, filed. Aug. 31, 2010 is expressly incorporated by reference herein.

BACKGROUND

1. Technical Field

The present invention relates to a dot impact printer that prints on a recording medium, and relates more particularly to a dot impact printer that can reduce variation in the platen gap even when the printhead unit is repeatedly installed and removed.

2. Related Art

Printers used in photo minilabs that have image printers for printing photographs include correction value printers (CVP) and back printers for printing specific information on the back side of paper (recording medium) on the front side of which an image is printed by an image printer.

Dot impact printers that print by driving the head pins of the recording head against the recording medium with an ink ribbon therebetween are commonly used as back printers in such minilabs. Dot impact printers are simple and small, and therefore suited to printing specific information such as the date printed or an image ID number.

Dot impact printers used as back printers are normally disposed well inside the printing system, which uses the image printer as the main printing device. To facilitate replacing the ribbon cassette and other maintenance operations, the printhead unit on which the wire dot head and ribbon cassette are carried can be positioned to the printing position and the ribbon replacement position using a linkage mechanism or other type of unit conveyance mechanism.

When using a wire dot recording head (wire dot head) that prints by striking the paper with head pins (wires) through an ink ribbon, however, the size of the gap between the platen and the wire dot head (the platen gap) affects print quality, particularly the print density and multipart form printing capacity. Precisely adjusting the platen gap in such printers is therefore necessary.

Japanese Unexamined Patent Appl. Pub. JP-A-H10-202981 therefore teaches inserting a gap gauge between the platen and the distal ends of the wires of the wire dot head to optimally adjust the gap therebetween in such dot impact printers.

Dot impact printers conventionally used as back printers are, however, disposed deep inside the printing system, and the printhead unit must be removed using a unit conveyance mechanism every time the ribbon cassette is replaced. The platen gap between the wire dot head carried on the printhead unit and the platen disposed to the paper conveyance path inside the printing system is therefore not stable, possibly resulting in such problems as variations in the print density and a drop in wire doll head durability.

SUMMARY

A dot impact printer according to the invention can suppress variation in the platen gap even when the printhead unit is repeatedly replaced.

A first aspect of the invention is a dot impact printer including a printhead unit having a wire dot head that strikes an ink ribbon against a recording medium to print by a head pin, and a head support frame that supports the wire dot head; a path forming member that forms the recording medium conveyance path at a printing position of the wire dot head; and a first contact group having at least three contact points disposed to the head support frame that contact the path forming member proximally to the wire dot head and position to the path forming member in a head pin projection direction.

With the dot impact printer according to this aspect of the invention, the contact points of the first contact group disposed to the head support frame contact the path forming member that forms part of the recording medium conveyance path at the printing position proximally to the wire dot head when the printhead unit is set to the printing position.

The wire dot head supported on the head support frame is thus positioned in the head pin projection direction to the path forming member at the printing position.

The gap between the platen disposed to the conveyance path at the printing position and the wire dot head carried on the printhead unit is thus stable even after the printhead unit is repeatedly removed and installed, and variation in the platen gap can be suppressed.

A dot impact printer according to another aspect of the invention preferably also has a second contact group disposed to the head support frame. The second contact group has a contact point that contacts the path forming member at a position farther from the wire dot head than the contact points of the first contact group, and a height of the contact points of the second contact group are lower in the head pin projection direction than that of the contact points of the first contact group.

If the printhead unit moved to the printing position is greatly tilted to the path forming member, the angle of the printhead unit is corrected by the contact point of the second contact group contacting the path forming member first. After the tilt of the printhead unit is thus corrected, the contact points of the first contact group, which are taller in the head pin projection direction than the contact points of the second contact group, contact the path forming member at a position proximal to the wire dot head.

Compared with when the printhead unit contacts the path forming member at a significant angle, the contact points of the first contact group prevent the impact strength of the individual contact points being uneven due to the effect of the friction resistance of the contacting parts.

When the tilt of the printhead unit is corrected by the contact points of the second contact group, more accurate positioning in the head pin projection direction to the path forming member is possible because the contact points of the first contact group contact the path forming member at a position closer to the wire dot head than the second contact group, which reduces the effect of warping in the path forming member, for example.

Further preferably, the printhead unit has a pair of wire dot heads. By using a pair of wire dot heads in the printhead unit, more information can be printed on the recording medium. Even though the effect of tilt on the printhead unit that is moved to the printing position is increased by having a pair of wire dot heads, variation in the platen gap can be suppressed because the wire dot heads are positioned in the head pin projection direction to the path forming member at the printing position.

In another aspect of the invention, the printhead unit is preferably used for printing specific information on a back side of photograph.

With the dot impact printer according to aspect of the invention, product defects caused by dense back printing being visible from the photograph side can be prevented because the platen gap is stable and variation in the print density during back printing can be suppressed.

Yet further preferably in another aspect of the invention, the printhead unit is elastically urged toward the path forming member by an urging means.

With the dot impact printer according to this aspect of the invention, when the printhead unit is set to the printing position, the contact points of the first contact group are elastically urged to and contact the path forming member near the wire dot head. The force of each contact point is the same, and the printhead unit can be more accurately positioned in the head pin projection direction to the path forming member.

A dot impact printer according to another aspect of the invention also has a unit conveyance mechanism that moves the printhead unit to the printing position or a ribbon replacement position.

With the dot impact printer according to this aspect of the invention, the printhead unit can be removed to the outside of the printer using the unit conveyance mechanism even when the printhead unit is positioned deep inside the printer, and replacing the ribbon cassette and other maintenance can be simplified. Even if the installation precision of the printhead unit that moves to the printing position drops as a result of using a unit conveyance mechanism such as a linkage mechanism, variation in the platen gap can be suppressed because the wire dot head is positioned in the head pin projection direction to the path forming member at the printing position.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a dot impact printer according to the present invention is described below with reference to the accompanying figures.

Figure 1:
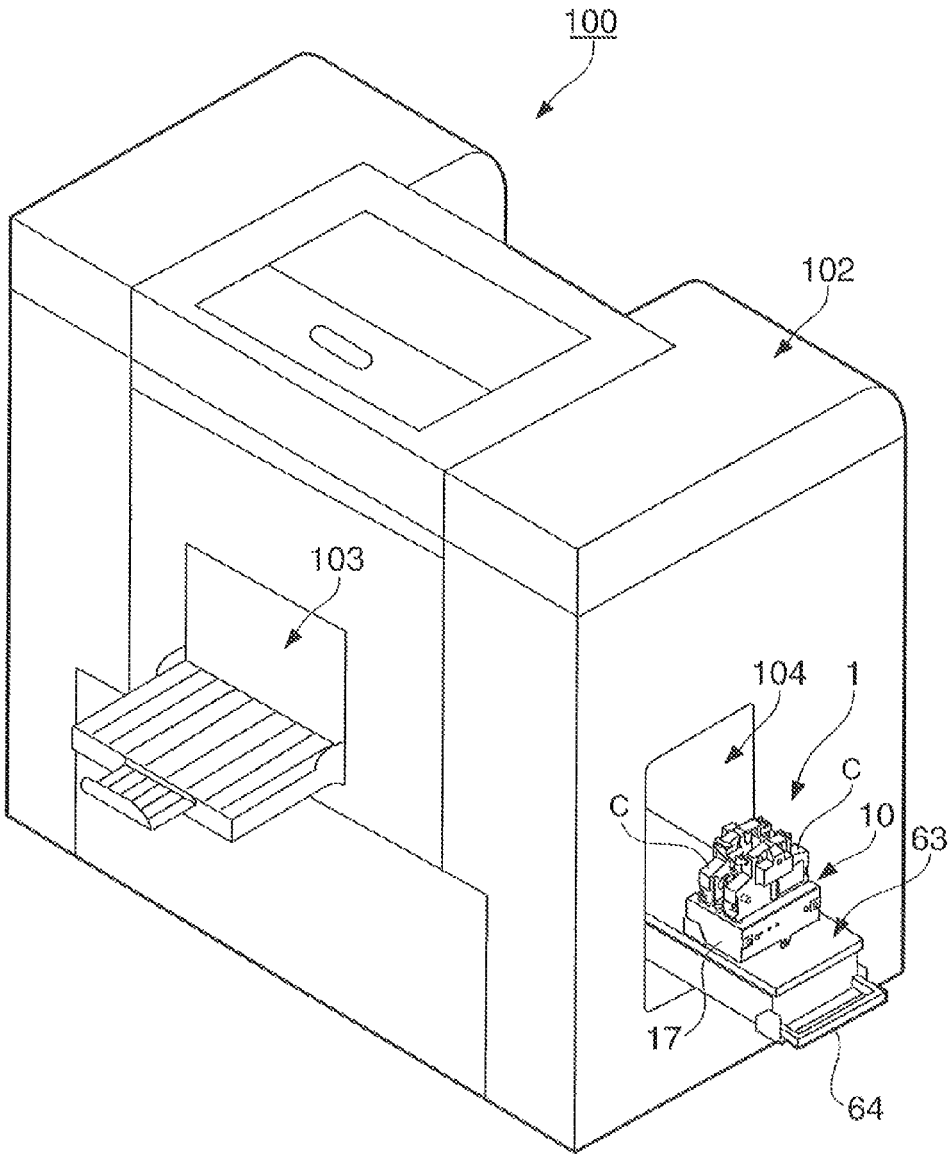
FIG. 1 is an external oblique view showing a printing system having a dot impact printer according to the invention when the dot impact printer is pulled outside the system housing.

As shown in FIG. 1, a printing system 100 having a dot impact printer 1 according to this embodiment of the invention is a printing system for a photo minilab having an inkjet printer or other type of image printer (not shown in the figure) for printing photographs inside a printer housing 102, which is basically shaped like a rectangular box.

A paper conveyance path 40 (conveyance path for the recording medium) is disposed inside the printer housing 102 from the paper feed unit at the back side to the sorter/discharge unit 103 at the front (see FIG. 3 to FIG. 6). The recording medium in this embodiment of the invention is paper P for printing photographs, and is supplied as roll paper that is stored in a supply unit. A desired image is printed by an image printer on the front (top) side of the roll paper conveyed to the image printing unit along the paper conveyance path from the supply unit.

After printing an image is completed, the roll paper is cut, dried, and conveyed through the paper conveyance path 40 to the back print unit. Specific information such as the date printed or an image identification number is printed by a dot impact printer 1 used as the back printer on the paper P conveyed to the back print unit, and the paper P is then discharged to the sorter/discharge unit 103.

Note that cut-sheet paper that is precut to a specified size may be used instead of roll paper as the recording medium.

The paper conveyance path 40 of the printing system 100 is arranged with the image printer inside the printer housing 102 as the main print unit, and the dot impact printer 1 disposed below the paper conveyance path 40 also located inside the printer housing 102. In order to facilitate replacing the ribbon cassette and other maintenance tasks, an access opening 104 is disposed in the side of the printer housing 102 so that the printhead unit 10 can be pulled outside the printer housing 102 using a unit conveyance mechanism 50 described below.

As shown in FIG. 2 to FIG. 6, the dot impact printer 1 according to this embodiment of the invention has a printhead unit 10 including a pair of wire dot heads 12 that drive head pins against the paper P with an ink ribbon 11 therebetween and a head support frame 15 that supports the wire dot heads 12; a bottom plate 41 and a top plate 42 that are path forming members rendering the paper conveyance path 40 at the position of the wire dot heads 12; and a pair of platens 45 disposed opposite the wire dot heads 12 with the paper conveyance path 40 therebetween.

Each wire dot head 12 has a plurality of head pins (such as 9 pins), and records characters on the paper P by causing the head pins to strike the ink ribbon 11 and transfer ink from the ink ribbon 11 to the paper P conveyed through the paper conveyance path 40 passed the wire dot head 12.

Each wire dot head 12 has a main body 13 that drives the head pins, and a nose 14 that guides the plural head pins of the head pin array.

A pair of cassette holders 18 that each removably hold a ribbon cassette C are disposed on opposite sides of the head support frame 15, which is supported and affixed to the top of a substantially rectangular main base 17, is disposed to the wire dot head 12 in this embodiment of the invention.

An endless ink ribbon 11 stored in a ribbon cassette C installed to the cassette holder 18 is driven in the paper conveyance direction between the wire dot head 12 and the platen 45 by a ribbon drive mechanism 20 disposed to the cassette holder 18. This ribbon drive mechanism 20 includes a drive motor 21 and a transfer mechanism 22 that drive motor 21 rotation to the drive nip roller inside the ribbon cassette, and ribbon drive mechanism 20 operation is controlled by a control unit not shown.

The head support frame 15 in this embodiment of the invention includes a base unit 15*a* attached to the main base 17, and a rectangular frame-shaped head support unit 15*b* rendered in unison with the top of the base unit 15*a*.

A pair of head holding units 15*c* are disposed parallel to the paper conveyance direction, and a wire dot head 12 is supportably fastened to each head holding unit 15*c*.

A holding channel in which the distal end of the nose 14 of the wire dot head 12 is fit, and a screw hole for fastening the nose 14 with a screw, is formed in the head holding unit 15*c*.

A first contact group 25 is disposed to the head support frame 15 near the head holding unit 15*c*. The first contact group 25 includes four contact points 25*a* to 25*d* that contact the opposing (bottom) face of the bottom plate 41 at the printing position for positioning relative to the bottom plate 41 in the direction in which the head pins are driven (vertically in the figures).

These contact points 25*a* to 25*d* in this embodiment of the invention are disposed on the upstream and downstream sides of the head holding unit 15*c* in the paper conveyance direction.

A second contact group 26 is also disposed to the head support frame 15. The second contact group 26 has contact points 26*a* to 26*d* that contact the bottom plate 41 at positions further removed from the wire dot head 12 than the contact points 25*a* to 25*d* of the first contact group 25. Note that the contact points 26*a* to 26*d* of the second contact group 26 are set lower than the contact points 25*a* to 25*d* of the first contact group 25 in the head pin projection direction.

A pair of positioning holes 24 is also disposed to the head support frame 15. A pair of positioning pins 44 that protrude down from the bottom of the bottom plate 41 fit into these positioning holes 24, thereby positioning the head support frame 15 to the bottom plate 41 in the plane direction of a plane perpendicular to the head pin projection direction.

A pair of openings 43 is formed in the bottom plate 41 in this embodiment of the invention to expose the distal end of the nose 14 of the wire dot head 12 to the paper P conveyed through the paper conveyance path 40, and the pair of platens 45 is disposed to the top plate 42 opposite these openings 43. The position of these platens 45 relative to the thickness direction of the top plate 42 is adjustable, and the platen gap between the distal end of the nose 14 of the wire dot head 12 and the platen 45 can be adjusted.

Figure 3:
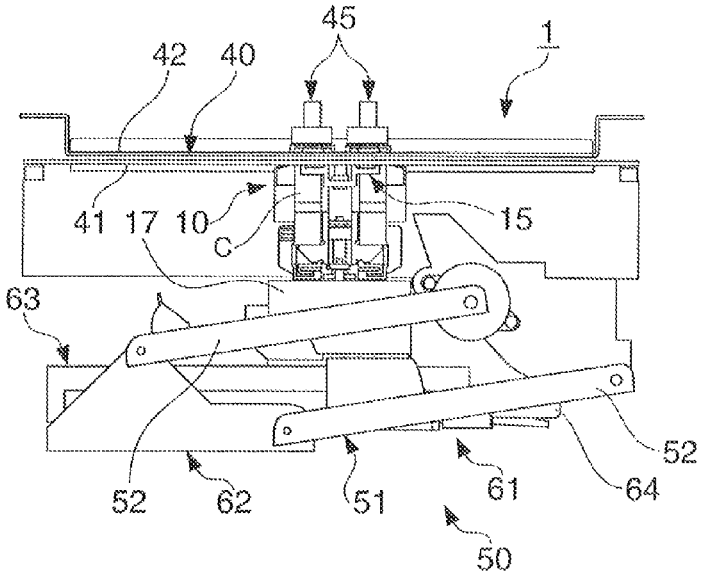
FIG. 3 schematically describes the unit conveyance mechanism for moving the dot impact printer shown in FIG. 1 to the ribbon replacement position outside the printing system.
Figure 4:
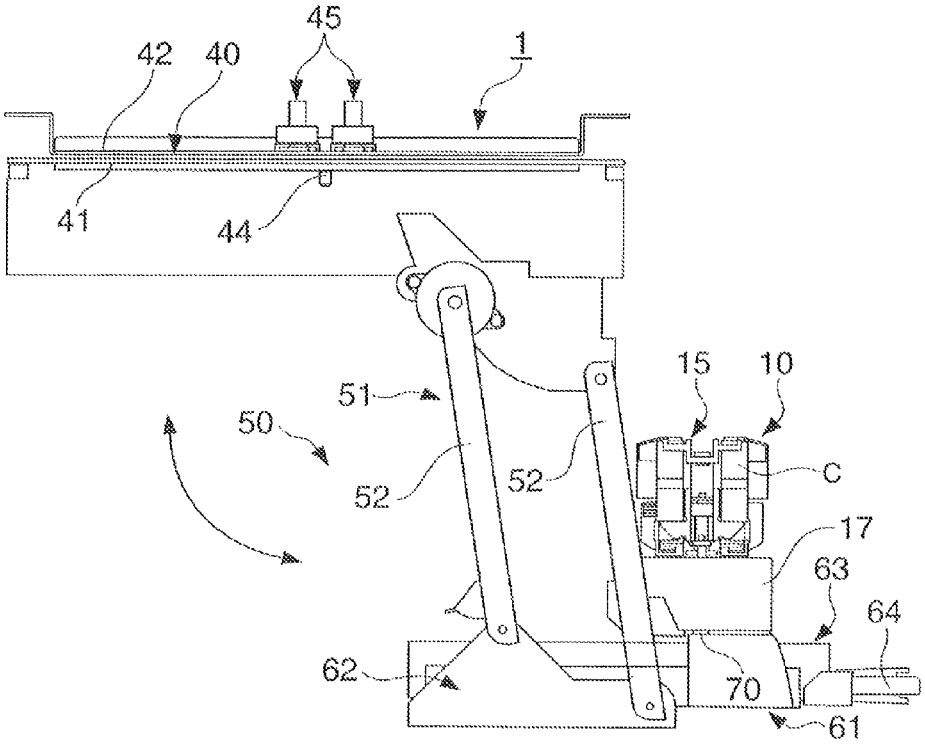
FIG. 4 schematically describes moving the dot impact printer to the ribbon replacement position outside the printing system by means of the unit conveyance mechanism shown in FIG. 1.

As shown in FIG. 3 and FIG. 4, the unit conveyance mechanism 50 according to this embodiment of the invention combines a linkage mechanism 51 and a slide mechanism 61. The linkage mechanism 51 moves a slide base 62 vertically between a position proximal to the paper conveyance path 40 and a down position removed therefrom. The slide mechanism 61 moves a slider 63 on which the printhead unit 10 is mounted horizontally on the slide base 62 to the outside of the case.

The linkage mechanism 51 has a link arm 52 of which one end is freely rotatably attached to the printer housing 102 side and the other end is freely rotatably attached to the slide base 62, and moves the slide base 62 vertically while holding it level to a position proximal to the paper conveyance path 40 and a down position removed from the paper conveyance path 40.

After the slider 63 is moved to the down position away from the paper conveyance path 40 by the linkage mechanism 51, the slide mechanism 61 can move the printhead unit 10 on the slider 63 horizontally through the access opening 104 to the outside of the printer housing 102 as shown in FIG. 1.

Figure 2:
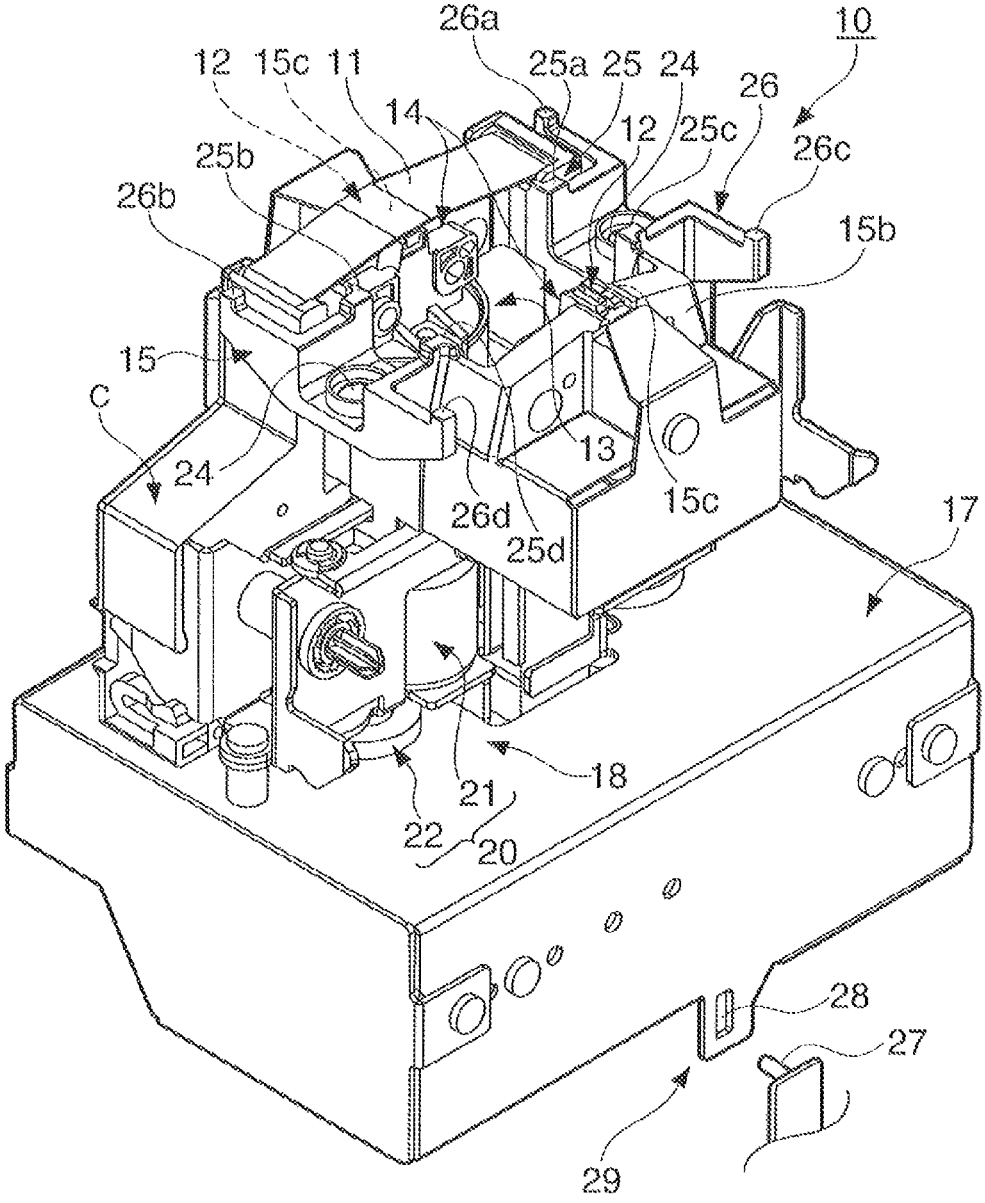
FIG. 2 is an external oblique view of the dot impact printer shown in FIG. 1 when the front (outside) ribbon cassette has been removed.

A support 29 in which a long hole 28 is formed vertically is rendered from the bottom on both sides of the main base 17 of the printhead unit 10 according to this embodiment of the invention, and an engagement pin 27 disposed to the slider 63 side is fit into the long hole 28 of the support 29 (see FIG. 2). A compression spring (urging member) 70 is inserted between the main base 17 and the slider 63 (see FIG. 4).

The printhead unit 10 is mounted on the slider 63 with the compression spring 70 elastically urging the printhead unit 10 upward from the slider 63, and when the printhead unit 10 is set to the printing position, the contact points 25*a* to 25*d* of the first contact group 25 contact the bottom plate 41 proximally to the wire dot head 12 with elastic pressure applied thereto.

Operation of the printhead unit 10 when replacing the ribbon cassette is described next with reference to FIG. 3 to FIG. 6.

As shown in FIG. 3, the printhead unit 10 of the dot impact printer 1 according to this embodiment of the invention is positioned below the paper conveyance path 90 inside the printer housing 102 when in the printing position, and the user cannot touch the ribbon cassette C held in the cassette holder 18 of the printhead unit 10. Operation of the unit conveyance mechanism 50 is locked at this time by a lock mechanism not shown, and the slider 63 will not move unintentionally if the user does not release the lock.

To remove the printhead unit 10 of the dot impact printer 1 to the outside of the printer housing 102, the user releases the lock mechanism and then holds and pulls out on the operating handle 64 disposed to the distal end of the slider 63. As a result, as shown in FIG. 4, the slide base 62 is held horizontally as it moves with the slider 63 to a position removed down and away from the paper conveyance path 40.

When the user pulls the operating handle 64 forward, the slider 63 moves horizontally with the slide base 62 to the outside, and the printhead unit 10 carried on the slider 63 can be moved to the ribbon replacement position outside the access opening 104 of the printer housing 102 as shown in FIG. 1.

To return the printhead unit 10 inside the printer housing 102, the user holds the operating handle 64 and pushes the slider 63 inside. As a result, the slider 63 moves with the slide base 62 to the inside as shown in FIG. 3.

When the user pushes the operating handle 64 further inside, the slider 63 moves to a position proximal to the paper conveyance path 40 while held horizontally by the linkage mechanism 51.

Figure 5:
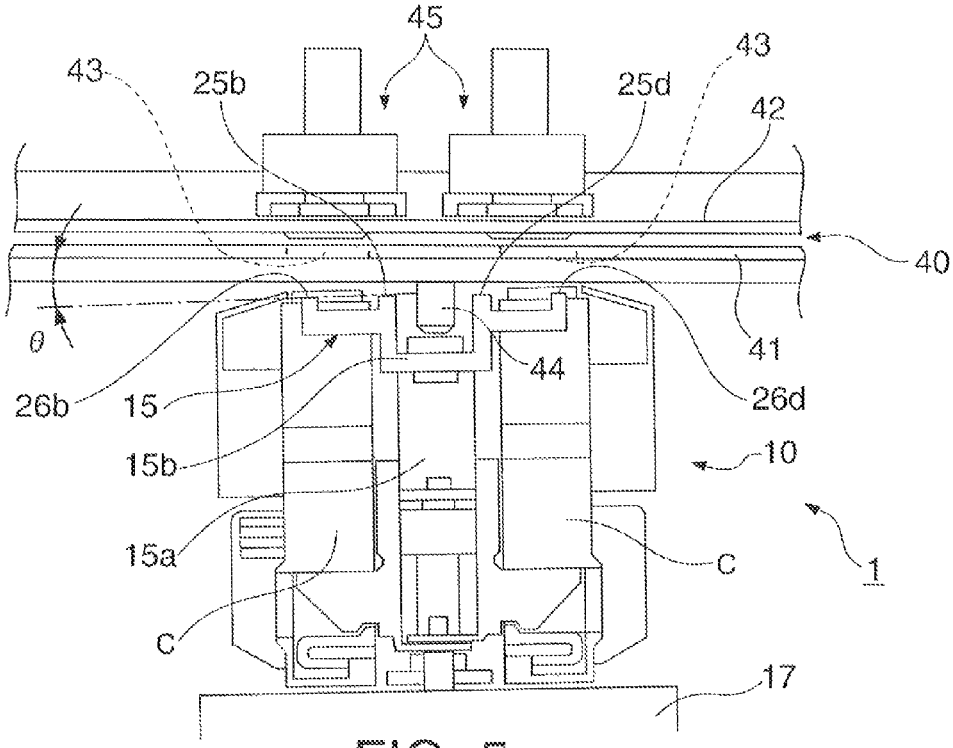
FIG. 5 is an enlarged view showing just before the dot impact printer shown in FIG. 3 is set to the printing position inside the printing system.

Due to variation in the dimensional precision and assembly of the parts of the linkage mechanism 51 and slide mechanism 61, the printhead unit 10 moved to the printing position by the unit conveyance mechanism 50 may be tilted to the bottom plate 41 by angle θ to the perpendicular to the bottom surface of the bottom plate 41 as shown in FIG. 5.

However, because contact points 26*c* and 26*d* of the second contact group 26 (that is, the contacts positioned higher than the other contacts due to the tilt of the printhead unit 10) contact the bottom of the bottom plate 41 first, the tilt of the printhead unit 10 is corrected by the time the contact points 25*a* to 25*d* of the first contact group 25 contact the bottom surface of the bottom plate 41 in the dot impact printer 1 according to this embodiment of the invention.

Figure 6:
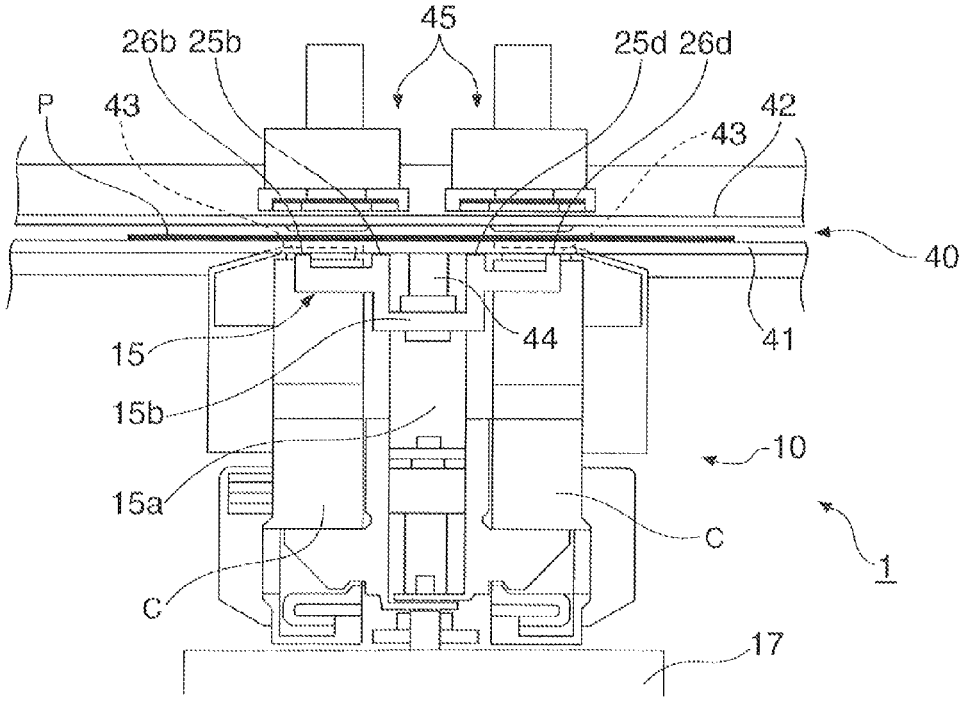
FIG. 6 is an enlarged view showing the dot impact printer shown in FIG. 3 set to the printing position inside the printing system.

After the tilt of the printhead unit 10 is corrected, the contact points 25*a* to 25*d* of the first contact group 25, which are taller in the head pin projection direction than the contact points 26*a* to 26*d* of the second contact group 26, ultimately contact the bottom of the bottom plate 41 proximally to the wire dot head 12 as shown in FIG. 6.

More specifically, as a result of rendering the contact points 26*a* to 26*d* of the second contact group 26, the impact strength of the contact points 25*a* to 25*d* of the first contact group 25 is more uniform at each of the contact points 25*a* to 25*d* due to the effect of the frictional resistance of the contact points than the impact strength of the contact points 25*a* to 25*d* of the first contact group 25 when the first contact group 25 contacts the bottom of the bottom plate 41 when the printhead unit 10 does not have the second contact group 26.

The printhead unit 10 of which tilt is corrected by the contact points 26*a* to 26*d* of the second contact group 26 is thus accurately positioned to the bottom plate 41 in the head pin projection direction by means of the contact points 25*a* to 25*d* of the first contact group 25 uniformly contacting the bottom surface of the bottom plate 41 proximally to the wire dot head 12 disposed further inside than the second contact group 26 where the effect of bottom plate 41 warping, for example, can be reduced.

The printhead unit 10 according to this embodiment of the invention is disposed to the slider 63 while urged up from the slider 63 by a compression spring 70, and when set to the printing position the contact points 25*a* to 25*d* of the first contact group 25 contact the bottom plate 41 proximally to the wire dot head 12 due to the urging force of the compression spring 70.

The impact force of the contact points 25*a* to 25*d* is therefore uniform, and the printhead unit 10 can be accurately positioned to the bottom plate 41 in the head pin projection direction.

Therefore, even when the unit conveyance mechanism 50 is repeatedly used to move the printhead unit 10 to the ribbon replacement position and then return it to the printing position every time the ribbon cassette is replaced, variation in contact between the contact points 25*a* to 25*d* of the first contact group 25 of the head support frame 15 that contact the bottom of the bottom plate 41 for vertical positioning is suppressed, and the platen gap is stable. As a result, variation in print density is prevented and a loss in printhead unit 10 durability is prevented.

The dot impact printer 1 according to this embodiment of the invention can print more information on the paper P by using a pair of wire dot heads 12 in the printhead unit 10. Even though the effect of tilt on the printhead unit 10 that moves between the ribbon replacement position and printing position is increased by having a pair of wire dot heads 12, variation in the platen gap can be suppressed as described above because the wire dot heads 12 are positioned in the head pin projection direction to the bottom plate 41 at the printing position.

The printhead unit 10 of the dot impact printer 1 according to this embodiment of the invention is used to print specific information on the back side of pictures, and can also prevent product defects caused by dense back printing being visible from the photograph side because the platen gap is stabilized and variation in the print density during back printing can be suppressed.

The configuration of the wire dot head, head support frame, printhead unit, conveyance path members, first and second contact groups, and the unit conveyance mechanism in the dot impact printer according to the invention is not limited to the configuration of the embodiment described above, can be varied in many ways without departing from the scope of the accompanying claims.

Figure 7:
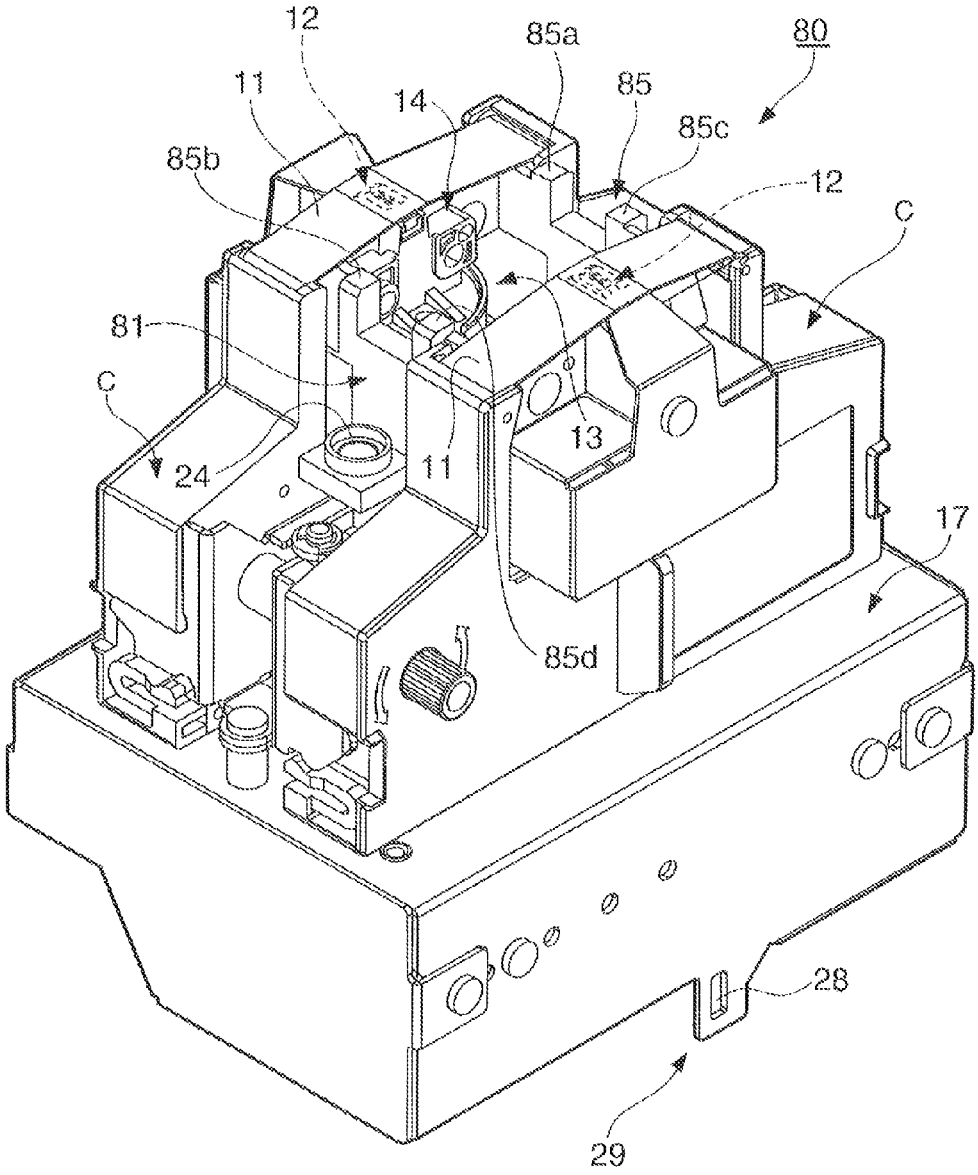
FIG. 7 is an external oblique view of a dot impact printer according to another embodiment of the invention.

For example, a printhead unit 10 that has a head support frame 15 to which a second contact group 26 of contact points 26*a* to 26*d* that contact the bottom plate 41 at a position farther from the wire dot head 12 than the contact points 25*a* to 25*d* of the first contact group 25 is described in the embodiment above. Alternatively, as shown in FIG. 7, the printhead unit 80 could have a head support frame 81 that has only a first contact group 85 with four contact points 85*a* to 85*d* for positioning to the bottom plate 41 in the head pin projection direction by contacting the bottom surface of the bottom plate 41 proximally to the wire dot head 12.

More specifically, when the unit conveyance mechanism that moves the printhead unit 80 to the printing position and the ribbon replacement position is a simple mechanism that, for example, moves the printhead unit 80 only in the head pin projection direction, variation in the dimensional precision and assembly of the parts rendering the unit conveyance mechanism can be reduced. As a result, even without using a second contact group to correct tilting of the printhead unit 80, the contacts 85*a* to 85*d* of the first contact group 85 that uniformly contact the bottom of the bottom plate 41 can alone correct positioning to the bottom plate 41 in the head pin projection direction.

A first contact group 25 (85) having four contact points is described by way of example in the foregoing embodiment, but the invention is not so limited. More particularly, it will be obvious that the first contact group only needs three contact points to enable positioning to the path forming member in the head pin projection direction.

In addition, the foregoing embodiment describes using a dot impact printer 1 as a back printer in a photo minilab system, but the dot impact printer of the invention is not so limited and can be applied to other types of printing devices.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A dot impact printer comprising:

a printhead unit having a wire dot head configured to strike an ink ribbon against a recording medium to print by a head pin, and a head support frame that supports the wire dot head;

a path forming member configured to form the recording medium conveyance path at a printing position of the wire dot head;

a first contact group having at least three contact points disposed to the head support frame configured to contact the path forming member proximally to the wire dot head and position to the path forming member in a head pin projection direction; and a second contact group disposed to the head support frame, wherein the second contact group has a contact point configured to contact the path forming member at a position farther from the wire dot head than the contact points of the first contact group; and wherein a height of the contact point of the second contact group is lower in the head pin projection direction than that of the contact points of the first contact group.

2. The dot impact printer described in claim 1, wherein the printhead unit has a pair of wire dot heads.

3. The dot impact printer described in claim 1, wherein the printhead unit is used for printing specific information on a back side of photograph.

4. The dot impact printer described in claim 1, wherein the printhead unit is elastically urged toward the path forming member by an urging member.

5. The dot impact printer described in claim 1, further comprising:

a unit conveyance mechanism configured to move the printhead unit to the printing position or a ribbon replacement position.

* * * * *